US005731660A

United States Patent [19]

Jaskie et al.

[11] Patent Number: 5,731,660

[45] Date of Patent: Mar. 24, 1998

[54] FLAT PANEL DISPLAY SPACER STRUCTURE

[75] Inventors: James E. Jaskie, Scottsdale; Jeffery A. Whalin, Fountain Hills; Ronald O. Petersen, Phoenix, all of Ariz.

[73] Assignee: Motorola, Inc., Schaumburg, Ill.

[21] Appl. No.: 573,986

[22] Filed: Dec. 18, 1995

[51] Int. Cl.[6] ..... H01J 19/24; H01J 19/42

[52] U.S. Cl. ..... 313/495; 313/292; 313/493; 313/496; 313/257; 313/309

[58] Field of Search ..... 313/495, 309, 313/496, 497, 351, 336, 257, 292, 560, 493

[56] References Cited

U.S. PATENT DOCUMENTS 5,448,131 9/1995 Taylor et al. ..... 313/309

5,508,586 4/1996 Martelli et al. ..... 313/560

5,587,623 12/1996 Jones ..... 313/309

*Primary Examiner*—Sandra L. O'Shea

*Assistant Examiner*—Joseph Williams

*Attorney, Agent, or Firm*—Eugene A. Parsons

[57] ABSTRACT

A display spacer structure includes a frame with side members joined together to define a central opening. The side members have recessed portions positioned outside of, and in communication with, the central opening with getter material therein. Spaced apart grooves are formed in each of an opposed pair of the side members, and the ends of a plurality of spacers are fixed in the grooves. The spacers extend across the central opening to define a plurality of separate compartments which are in communication with the recessed portions so as to provide a continuous fluid phase throughout all the separate compartments.

32 Claims, 8 Drawing Sheets

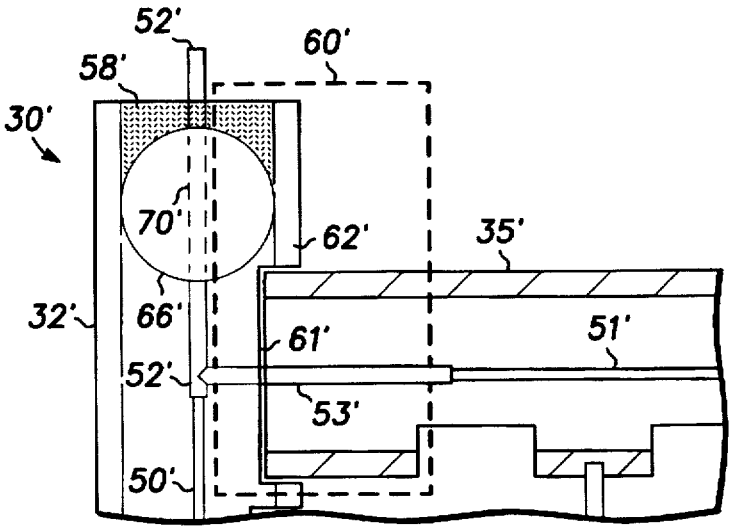
FIG. 13
14'
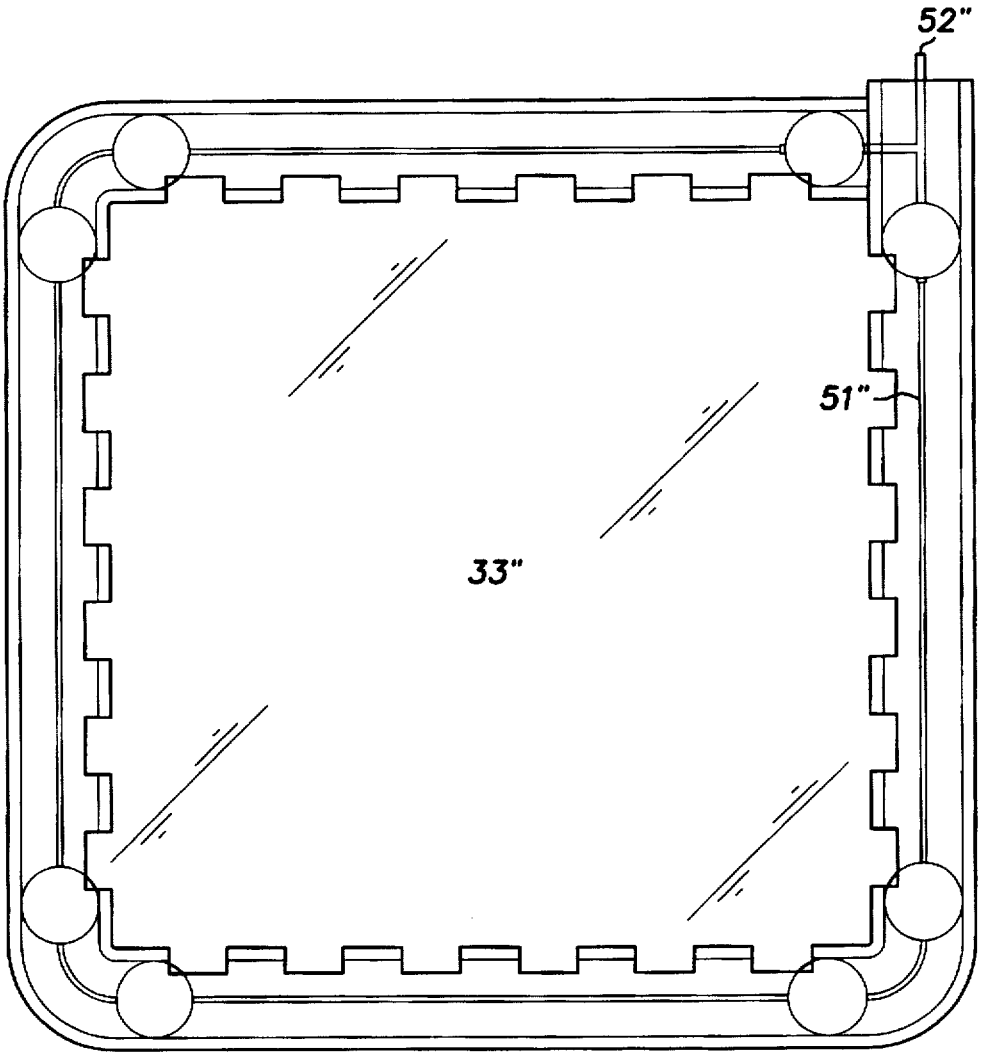
FIG. 15 14"

30

14

FLAT PANEL DISPLAY SPACER STRUCTURE

FIELD OF THE INVENTION

The present invention pertains to spacer structures for flat panel displays and more specifically to a display spacer which includes a frame for the alignment of the spacers, placement of getter, and the maintenance of uniform pressure throughout the display.

BACKGROUND OF THE INVENTION

Spacers are required in field emission displays to provide structural support to prevent the collapse of the display, the inner volume of which is under vacuum while the external surfaces are exposed to atmospheric pressure. A variety of spacer structures for flat panel displays have been proposed in the past. The fabrication of many of these structures includes photolithography, etching, and/or high-temperature bake-out steps which are performed after the electron emitters are formed. (An example of a field emission device used in flat panel displays is described in U.S. Pat. No. 5,142,184, entitled "Cold Cathode Field Emission Device with Integral Emitter Ballasting", issued to Robert C. Kane on Aug. 25, 1992.) The present invention does not require most of the above costly and difficult fabrication steps.

Some proposed spacer structures are formed by the extrusion of various cross-sections, resulting in individual posts which are individually placed on designated locations of the display panel. This method may not be cost effective.

Other proposed spacer structures are fabricated from metals, which, if not coated with a dielectric, have a detrimental effect on the electrical properties of the emission region. However, it is not practical nor reliable to simply coat the metal with a dielectric.

Some spacer schemes involve placing prefabricated spacers into grooves or slots in the anode or cathode plates. These schemes present certain difficulties which are more easily avoided by the present invention. Field emission displays require a spacer with a relatively high aspect ratio (the ratio of height to width) of about 10. The spacers require a height of about one millimeter and a width of about 100 micrometers. An important goal is to maintain perpendicularity between the spacer and both the anode and the cathode. If the spacer is positioned by using a slot in the anode or cathode surfaces and the slot is wider than the spacer thickness, the spacer may tilt and contact the plates at an angle. As this angle deviates from 90 degrees, the structural-support function of the spacer is rapidly compromised.

Accordingly, it would be highly desirable to provide a spacer structure which is simple to fabricate and align.

Another problem in the fabrication of spacer structures for field emission displays is compartmentalizing the display so that different compartments are not in fluid communication with each other, a situation which results in nonuniformities in the vacuum properties across the display. Nonuniformities in vacuum properties adversely affect the final visual image of the display. Some proposed spacer structures in the past have included holes or grooves in the spacers to create the fluid communication between the compartments. This method, however, compromises the mechanical integrity of the spacer.

The removal of gaseous contaminants in field emission displays is accomplished by the use of gettering materials, which are currently positioned in the corners of the display, outside the active emission region. Because the getter is not distributed throughout the display, or even along the lengths of the frame, the result is that the ratio of active area to total display area is low.

Accordingly, it would be highly desirable to provide a method of distributing the getter material so that it increases the ratio of active area to total display area.

Additionally, it is not facile, at present, to affect enhanced gettering action once the display has been hermetically sealed. Certain packaging steps, as well as the initial activation of the display, may cause unusually high outgassing events in the display.

Accordingly, it would be highly desirable to provide a spacer structure which allows temporary enhancement of the gettering action in the display to temporarily increase the rate at which contaminants are removed.

A problem with providing spacers for a field emission display is the potential distortion in the visual image due to the presence of the spacer structure. For example, if alignment grooves are formed in the anodic face plate, the grooves may distort the image. Additionally, if the spacer structure is aligned along the horizontal or vertical directions of the plane of the display, the resultant irregularity is more easily discernible by the human eye; whereas, if the irregularity in the image is oriented at a different angle (for example, 45 degrees to the horizontal), the human eye has more difficulty discerning it.

Accordingly, it would be highly desirable to provide a spacer structure which does not require forming grooves into the face plate, and a way to easily position the spacers along lines which are at an angle to the horizontal across the plane of the display.

It is a purpose of the present invention to provide a new and improved display spacer structure for a field emission display.

It is another purpose of the present invention to provide a new and improved display spacer structure which maintains uniformity of vacuum properties over space and time and thus maintains a high quality visual image.

It is still another purpose of the present invention to provide a new and improved display spacer structure which is relatively simple to manufacture and handle.

It is still another purpose of the present invention to provide a new and improved display spacer structure which is relatively inexpensive to manufacture.

It is still another purpose of the present invention to provide a new and improved display spacer structure which is relatively simple to align to maximize the structural support of the face plate of the display and to minimize the adverse effects on the visual image due to the presence of the spacers.

It is still another purpose of the present invention to provide a new and improved display spacer structure which can contain an increased amount of getter distributed so as to increase the ratio of active area to total display area, and thus increase the lifetime and improve the performance of the display.

SUMMARY OF THE INVENTION

The above problems and others are at least partially solved and the above purposes and others are realized in a display spacer structure which includes a frame. The frame includes one or more side members joined together to define a central opening and to further define first and second spaced apart parallel planes at opposed ends of the central opening. At least one of the side members has a recessed portion which is positioned outside of, and in communication with, the central opening. A getter material is positioned in the recessed portion of at least one of the side members which have recessed portions.

The above problems and others are at least partially solved and the above purposes and others further realized in a display spacer structure which includes a frame including one or more side members joined together to define a central opening and to further define first and second spaced apart parallel planes at opposed ends of the central opening. At least one of the side members has a recessed portion positioned outside of, and in communication with, the central opening. A plurality of spaced apart grooves is formed in a first one of the side members and a similar plurality of spaced apart grooves is formed in a second one of the side members. A plurality of spacers each having first and second ends is fixed in the grooves in the first and second side members, respectively. The spacers extend across the central opening to define a plurality of separate compartments. The spacers extend generally perpendicularly into the first and second spaced apart parallel planes. The recessed portion of the first one of the side members is in communication with each of the separate compartments thereby providing a continuous fluid phase throughout the separate compartments.

The above problems and others are at least partially solved and the above purposes and others further realized in a method of fabricating a display spacer structure comprising the steps of providing one or more side members and joining the side members together to define a central opening and to further define first and second spaced apart parallel planes at opposed ends of the central opening. At least one side member is provided which has a recessed portion. The recessed portion is positioned outside of, and in communication with, the central opening. A getter material is provided and positioned in said recessed portion.

The above problems and others are at least partially solved and the above purposes and others further realized in a method of fabricating a display spacer structure comprising the steps of providing one or more side members and joining the side members together to define a central opening and to further define first and second spaced apart parallel planes at opposed ends of the central opening. At least one side member is provided having a recessed portion. The recessed portion is positioned outside of, and in communication with, the central opening. A plurality of spaced apart grooves is formed in a first one of the side members, and a similar plurality of spaced apart grooves is formed in a second one of the side members. A plurality of spacers is provided, each having first and second ends. The plurality of spacers is positioned in the grooves in the first and second side members, respectively, with the spacers extending across the central opening to define a plurality of separate compartments. The spacers extend generally perpendicularly into the first and second spaced apart parallel planes. The recessed portion of the first one of the side members is positioned in communication with each of the separate compartments thereby providing a continuous fluid phase throughout the separate compartments.

BRIEF DESCRIPTION OF THE DRAWINGS

Referring to the drawings:

FIG. 13 is an enlarged view, similar to FIG. 12, of another embodiment of a display spacer structure illustrating an alternate joint between adjacent side members of a frame in accordance with the present invention.

FIG. 15 is a simplified top plan view similar to FIG. 14 of another embodiment of the present invention.

DESCRIPTION OF THE PREFERRED EMBODIMENTS

Figure 1:
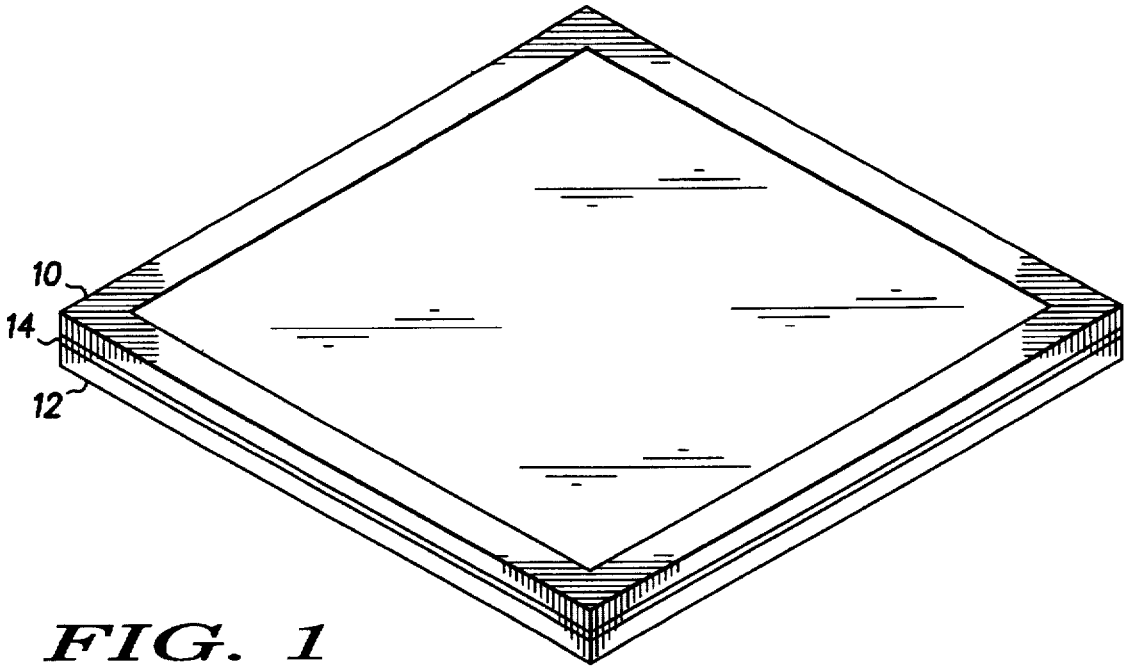
FIG. 1 is a perspective view of a flat panel display.

Referring now to FIG. 1 there is depicted a perspective view of a flat panel display having an anode structure 10, a cathode structure 12, and a display spacer structure 14 sandwiched therebetween in accordance with the present invention. The display is hermetically sealed to maintain a vacuum environment within it. Generally, anode structure 10, cathode structure 12, and spacer structure 14 are formed of sufficiently hard material to maintain a hermetic seal and to withstand the atmospheric pressure when the display is evacuated. Spacer structure 14 provides structural support to prevent the display from collapsing when the internal volume of the display is evacuated. As will be explained in detail later, spacer structure 14 also provides getter for the removal of gases to maintain the vacuum within the display, which is required for the proper operation of the display.

Figure 2:
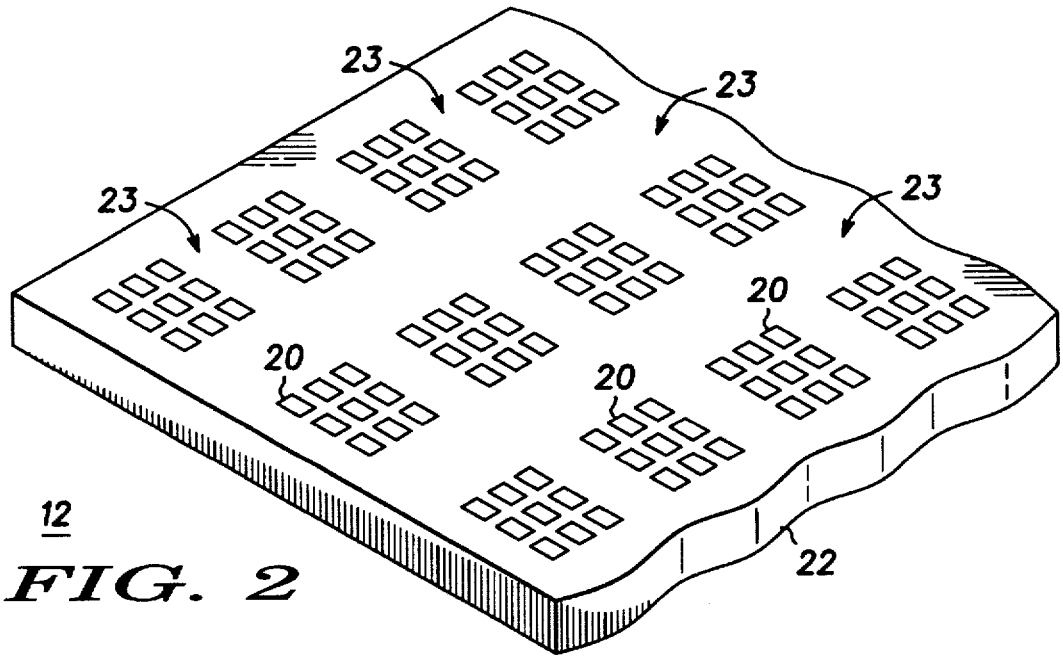
FIG. 2 is an enlarged perspective view of a portion of a cathode structure in the display of FIG. 1.

An enlarged perspective view of a portion of cathode structure 12 (in the display of FIG. 1) is illustrated in FIG. 2 having an array of pixels 20 formed on a face of cathode structure 12 which is positioned in the inner volume of the display. The pixel layout pattern is not limited to that illustrated in FIG. 2. Each pixel 20 in the array includes one or more electron emitters that emit electrons, when properly energized, through spacer structure 14 so as to impact on anode structure 10 and create light which contributes to the overall visual image of the display. Each pixel 20 may include, for example, a plurality of field emission devices (FEDs). An example of a FED is described in U.S. Pat. No. 5,142,184 entitled "Cold Cathode Field Emission Device with Integral Emitter Ballasting", and issued to Robert C. Kane on Aug. 25, 1992. To ensure that the emitted electrons from a given emitter impact the corresponding, or targeted, portion of anode structure 10—and thereby create the desired image—it is necessary to establish and maintain a good vacuum inside the display. Positioned between pixels 20, cathode surface regions 23 are available on which to position spacers and side members (described in detail below) of spacer structure 14, which will provide the structural support necessary to prevent the collapse of the display and maintain a predetermined spacing between anode structure 10 and cathode structure 12.

Figure 3:
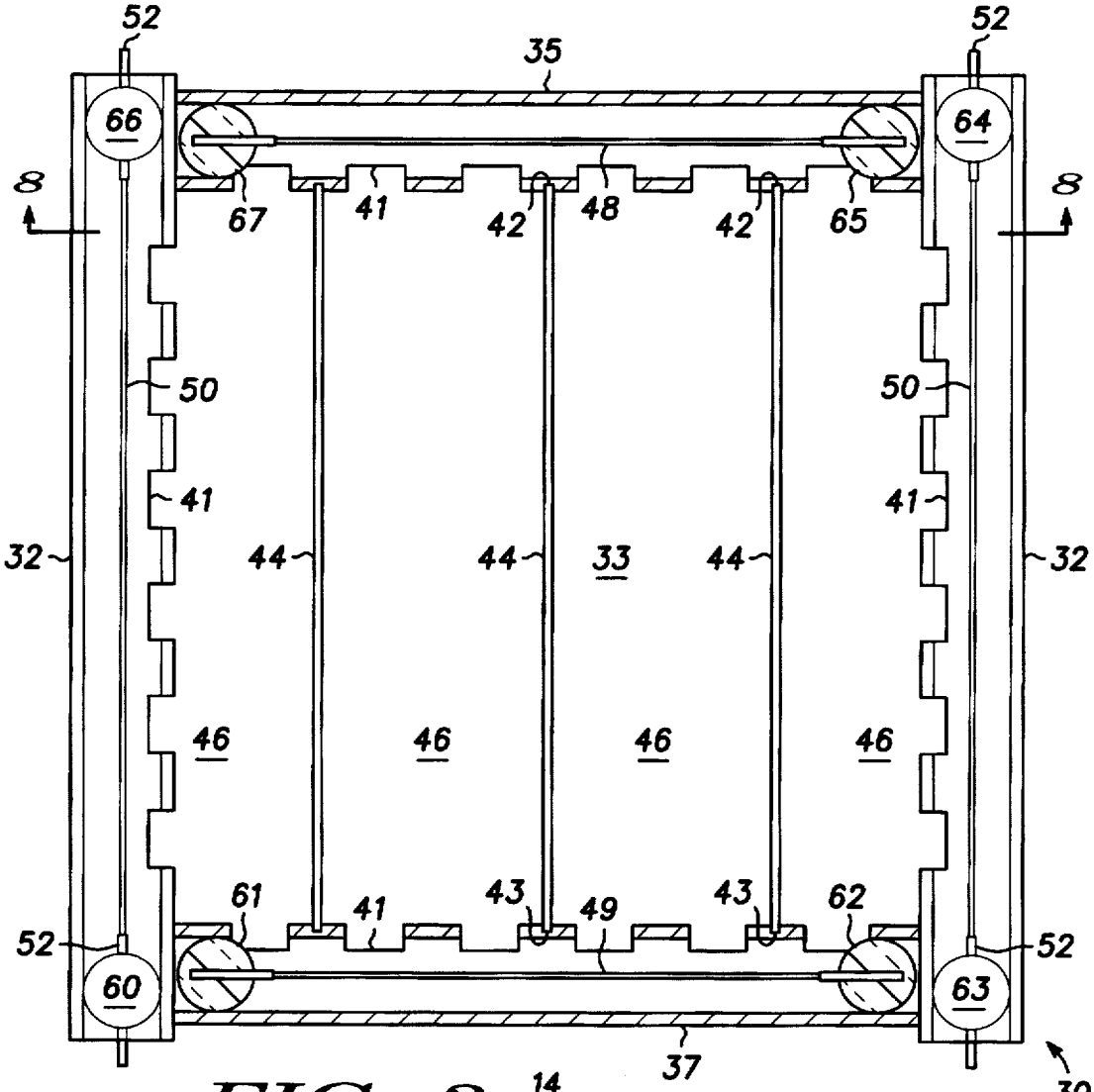
FIG. 3 is a plan view of a preferred embodiment of a display spacer structure included in the display of FIG. 1, in accordance with the present invention.

Illustrated in FIG. 3 is a plan view of a preferred embodiment of display spacer structure 14 (included in the display of FIG. 1) in accordance with the present invention. Display spacer structure 14 is comprised of a frame 30 including a side member 35 and an opposing side member 37, both of which are fixed to a pair of side members 32 adjacent the ends so as to define a central opening 33.

In the embodiment illustrated in FIG. 3, each side member 32 and opposing side members 35 and 37 include an elongated tube. Other variations are possible. For example, only one of the side members may include an elongated tube, and the remaining side members may, for example, be solid. Alternatively, the display frame could also be formed from one continuous side member, which could be a tube, having opposed ends. In this particular embodiment, the side member is bent into a desired frame shape, and the opposed ends are then joined together to close the frame.

Figure 5:
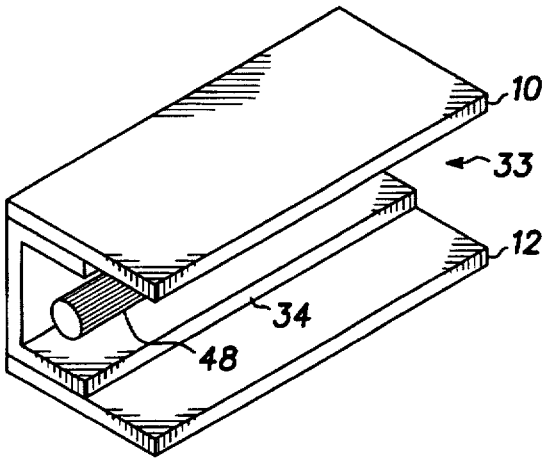
FIG. 5 is a perspective view of the side member of FIG. 4 and its positioning with respect to the anode and cathode structures.
Figure 4:
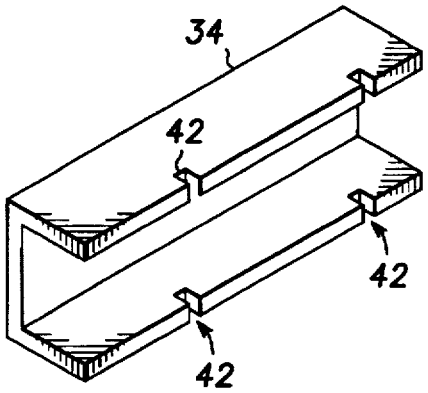
FIG. 4 is a perspective view of another embodiment of a side member for use in the structure of FIG. 3, portions thereof broken away, which includes a channel.

Side members 32 and opposing side members 35 and 37 of the embodiment illustrated in FIG. 3 are comprised of glass tubes, having circular cross-sections. Other materials may be used, such as ceramic or plastic; other cross-sectional shapes may be used, such as oval or square. The cross-sectional shape may be generally oval, having two flattened segments where contact is to be made with the cathode and anode structures, so that more area is available to make hermetic seals between the side member and the cathode and anode structures. Other embodiments of the present invention may include side members which are channels or bars that have z-shaped cross-sections, as will be described in greater detail below (FIGS. 4 and 5).

A plurality of spaced apart grooves 42 is formed in side member 35 and a similar plurality of spaced apart grooves 43 is formed in side member 37 such that a plurality of spacers 44 may be fixed within grooves 42 and 43 in accordance with the present invention. One end of each spacer 44 is positioned in a groove 42 in side member 35, and the other end is positioned in an opposing groove 43 in side member 37. Spacers 44 extend across central opening 33 to define a plurality of separate compartments 46. Each spacer has a height sufficient to allow it to be in abutting engagement with both the cathode and anode structures, 12 and 10, respectively, when they are affixed to display spacer structure 14.

Grooves 42 and 43 are formed by cutting the elongated tubes of side members 35 and 37 to a depth less than the thickness of the tube wall, with a diamond saw having a blade, for example, about 100 micrometers thick. Spacers 44 are formed by providing a sheet of glass and cutting the sheet into strips about 100 micrometers thick, or a thickness less than or equal to cathode surface regions 23 between pixels 20, and having a height of about one millimeter, or the distance between the inner surfaces of anode structure 10 and cathode structure 12, within a few per cent of the total height. Many spacers can be made simultaneously using a gang-cutter saw. The length of each spacer 44 is equal to the distance between the pair of grooves 42, 43 into which the ends of spacer 44 are fixed.

The spacer material and its properties need not be the same as those of anode or cathode structures 10, 12. Because spacers 44 are not rigidly fixed to these structures, spacers 44 are free to expand and contract during thermal treatments without creating significant stresses in spacers 44. Thus, differences in the thermal expansion coefficients of spacers 44 and structures 10 and 12 are tolerable in the present invention.

A plurality of spaced apart openings 41 is formed in side members 35 and 37, so that a uniform fluid pressure can be maintained throughout the display. For standardization in manufacturing, and for providing additional getter material (as will be described in more detail presently), side members 32 also have openings 41 formed therein. Each spaced apart opening 41 is in communication with the inner volume of its corresponding side member 32, 35, 37 and is positioned in and in communication with central opening 33. In alternate embodiments of the present invention, spaced apart openings 41 may be formed in only one of side members 35 or 37 or in a number less than the total number of side members comprising the display frame. Additionally, at least one spaced apart opening 41 is positioned in each of separate compartments 46, so that a continuous fluid phase and uniform vacuum conditions exist throughout all compartments 46. The combination of the elongated tube and openings 41 results in a recessed portion being positioned outside of, and in communication with, central opening 33.

In this specific embodiment, spaced apart openings 41 are formed by using a diamond saw having a blade thickness of about 500 micrometers. Other blade thicknesses, greater or smaller than 500 micrometers, may be used. Different methods of forming grooves 42, grooves 43, and spaced apart openings 41 include cutting with a water knife and thermal burn-out.

In an alternative embodiment of the present invention, the spacer grooves (similar to 42, 43) are cut into spaced apart openings 41, or they can be cut to a depth greater than the wall thickness of the elongated tube, so that the ends of the spacers are positioned in the inner volume of the elongated tube. By positioning spacer grooves 42, 43 further into side members 35, 37, closer to the tube axis, the groove contacts the end of spacer 44 at points further from the midpoint of the spacer height, thereby providing better spacer alignment and assuring perpendicularity of spacer 44 with the anode and cathode structures.

Spacers 44 are about 100 micrometers thick and 1 millimeter tall. (Spacers that are much thinner than 100 micrometers present handling and yield problems.) When spacers 44 have these dimensions, and when they are made of glass or ceramic, the total number of spacers 44, and the distance between adjacent spacers 44 (the pitch), are determined primarily by the thickness and strength of cathode and anode structures 12, 10. That is, when too few spacers 44 are employed, structures 12 and 10 will fail before spacers 44 fail. It has been determined that when structures 12 and 10 each have a thickness of 1.1 millimeters, the pitch, or distance between spacers 44, is 15 millimeters. Thus, if the display has a 10.25-inch diagonal (of the active area only) and if the lengths of spacers 44 are positioned along the vertical of the display, five of spacers 44 are generally used to support the display, each of these five spacers 44 thereby supporting about 168 pounds of force due to atmospheric pressure.

In the preferred embodiment, as illustrated in FIG. 3, a nonevaporable-type getter material 48 is positioned generally along the axis of the elongated tube of side member 35; another nonevaporable-type getter material 49 is similarly positioned in side member 37. Thus, getter materials 48 and 49 are positioned in the recessed portions of side members 35 and 37, respectively. A pair of evaporable-type getter materials 50 are positioned one each in side members 32. In this specific embodiment, getter materials 48, 49, and 50 are in the form of a wire held in place by means of blocking bodies 60–67, which may be for example glass or plastic beads. The wire is formed of a convenient metal and/or a getter, which may include titanium, barium, zirconium oxide, or some other suitable, active metal.

In the preferred embodiment, illustrated in FIG. 3, each of evaporable-type getter materials 50 includes a pair of externally accessible electrodes 52 which are positioned one each at the opposing ends of getter material 50 to electrically connect to an outside voltage source (not shown) which supplies a predetermined voltage. When the voltage is applied, the wire carries a current and generates heat which raises the temperature of getter materials 50. Getter is then released from the wire and sprayed onto the inner surfaces of side members 32, thereby providing enhanced gettering action. Nonevaporable-type getter materials 48 and 49 do not spray getter into the recessed portion of side members 35 and 37, respectively. However, the rate of removal of gaseous contaminants by nonevaporable-type getter materials 48 and 49 can be enhanced by an increase in temperature. The temperature increase of the getter can be affected by, for example, inductive heating or optical heating, such as heating with a laser. Thus, enhanced gettering action, or enhanced removal of gaseous contaminants inside the display, can be affected after the display has been hermetically sealed. This is beneficial because certain packaging steps, as well as the initial activation of the display, may cause unusually high outgassing events in the display. The ability to enhance the gettering action provides an increased rate of removal of gaseous contaminants during these, or other, outgassing events, thereby maintaining the appropriate vacuum conditions in the display.

Other combinations of getter materials may be used. For example, in another embodiment (which will be described in detail in the discussion of FIG. 10) of the present invention, all side members 32, 35, and 37 may contain evaporable-type getter materials which can be heated, or activated, by wires carrying current. Alternatively, only one of side members 32, 35, and 37 may contain getter material.

In another variation of the present invention, each side member 32, 35, and 37 includes, instead of a tube, a channel 34, as illustrated in FIG. 4. The volume enclosed by channel 34 defines the recessed portion of channel 34. Grooves 42 can be formed in the parallel plates of channel 34, as illustrated in FIG. 4. Illustrated in FIG. 5 is the positioning of cathode structure 12 and anode structure 10 with respect to channel 34: one of the flat side surfaces of channel 34 is in abutting engagement with anode structure 10, and the other, opposing flat side surface of channel 34 is in abutting engagement with cathode structure 12. Getter material 48 is positioned within the recessed portion of channel 34, which is outside of, and in communication with, central opening 33. In this particular embodiment, when spacers 44 are positioned in grooves 42, the recessed portion of channel 34 is in communication with each of separate compartments 46 thereby providing a continuous fluid phase throughout separate compartments 46.

Figure 6:
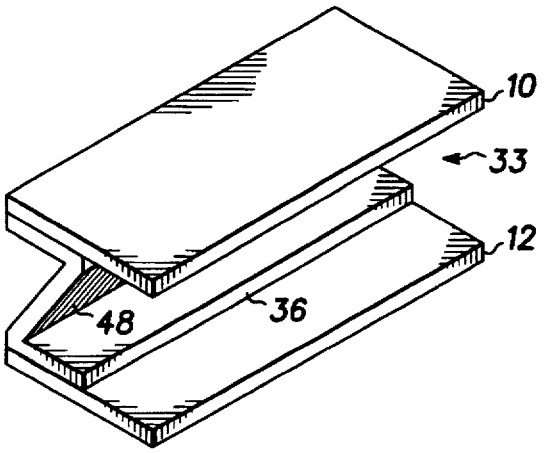
FIG. 6 is a perspective view of another embodiment of a side member for use in the structure of FIG. 3, portions thereof broken away, which includes a bar having a z-shaped cross-section.
Figure 7:
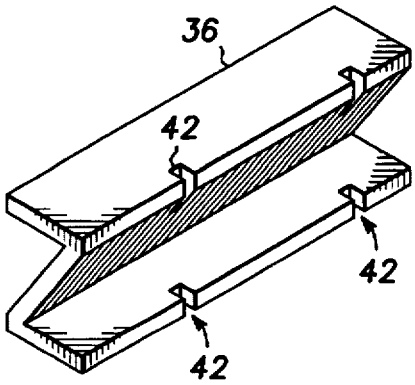
FIG. 7 is a perspective view of the side member of FIG. 6 and its positioning with respect to the cathode and anode structures.

In still another embodiment, each of side members 32, 35, and 37 includes a bar 36 having a z-shaped cross-section as illustrated in FIG. 6. Grooves 42 can be formed in the parallel plates of bar 36, as illustrated in FIG. 6. Illustrated in FIG. 7 is the positioning of anode structure 10 and cathode structure 12 with respect to bar 36: one of the elongated, flat side surfaces of bar 36 is in abutting engagement with anode structure 10, and the opposing flat side surface of bar 36 is in abutting engagement with cathode structure 12. The concave portion of bar 36 which is outside of, and in communication with, central opening 33 defines the recessed portion of bar 36. Getter material 48 is positioned within the recessed portion of bar 36 which is in communication with central opening 33. In this particular embodiment, when spacers 44 are positioned in grooves 42, the recessed portion of bar 36 is in communication with each of separate compartments 46 thereby providing a continuous fluid phase throughout separate compartments 46.

Figure 9:
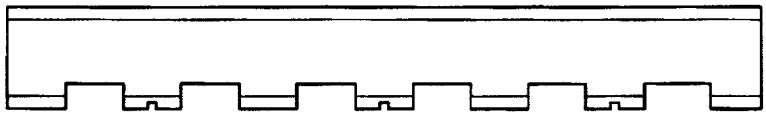
FIG. 9 depicts the side member, illustrated in FIG. 8, and further rotated 90 degrees about the tube axis.
Figure 10:
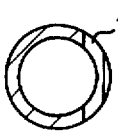
FIG. 10 is a cross-sectional view, as seen from the line 10—10 of FIG. 8, illustrating a groove in a side member of a frame in accordance with the present invention.
Figure 8:
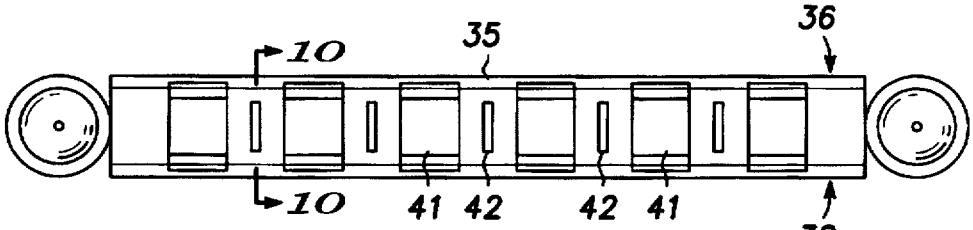
FIG. 8 is a cross-sectional view as seen from the line 8—8 of FIG. 3 illustrating openings and grooves in a portion of a side member in accordance with the present invention.

Side member 35 is illustrated in more detail and for better understanding in FIGS. 8, 9, and 10. Shown in FIG. 8 is a cross-sectional view of FIG. 3, taken along section line 8—8, which illustrates spaced apart openings 41 and grooves 42 of the preferred embodiment of the present invention. Also indicated in FIG. 8 are first and second spaced apart parallel planes 36 and 38, which are defined by side members 32, 35, and 37 and which are positioned at opposed ends of opening 33 (FIG. 3). The distance between first and second spaced apart parallel planes 36 and 38, in the present embodiment, is about one millimeter. Spacers 44 (FIG. 3) extend generally perpendicularly to first and second spaced apart parallel planes 36 and 38. Depicted in FIG. 9 is side member 35 as illustrated in FIG. 8 and further rotated 90 degrees about the tube axis. Illustrated in FIG. 10 is a cross-sectional view, as seen from the line 10—10 of FIG. 8, of one of grooves 42 in side member 35.

Figure 11:
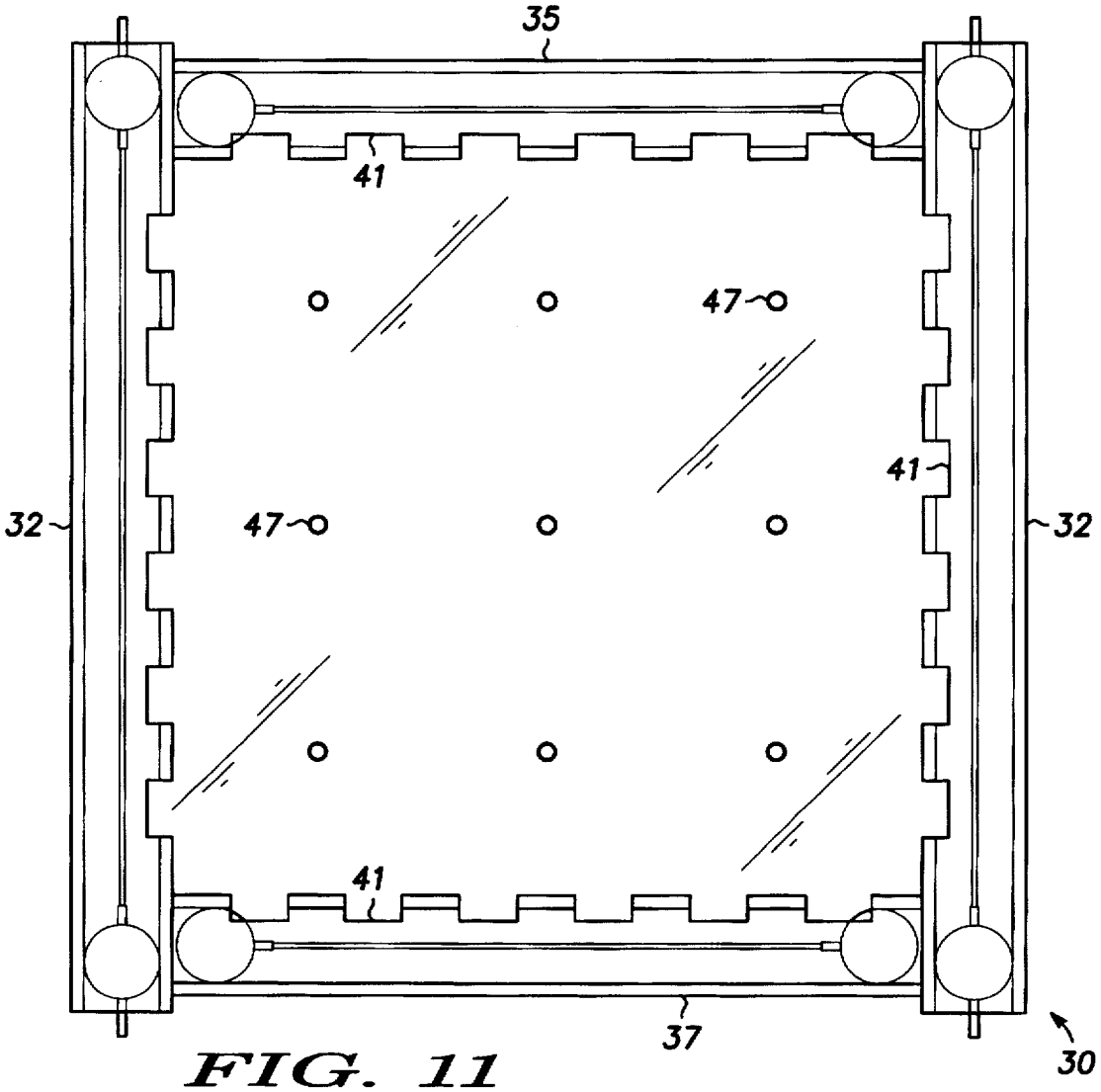
FIG. 11 is a top plan view, similar to FIG. 3, of another embodiment of the present invention illustrating the use of an alternate spacer in accordance with the present invention.

Illustrated in FIG. 11 is top plan view, similar to FIG. 3, of another embodiment of the present invention having a plurality of alternative spacers 47 distributed throughout the display. The view in FIG. 11 is that of frame 30 and spacers 47 positioned on either anode structure 10 or cathode structure 12, depending on the particular steps in the fabrication process. Spacers 47 have first and second opposed edges. In the finished display, the first opposed edge is in abutting engagement with anode structure 10; the second opposed edge is in abutting engagement with cathode structure 12 so as to prevent the collapse of the display when the display is evacuated. In this particular embodiment, spacers 47 need not be affixed to side members 32, 35, or 37; thus, side members 32, 35, and 37 do not include grooves. However, all other elements, including openings 41, of FIG. 3 are included in this embodiment. Spacers 47 may include any of several types of display spacers known in the art, such as posts, fibers, etc.

Figure 12:
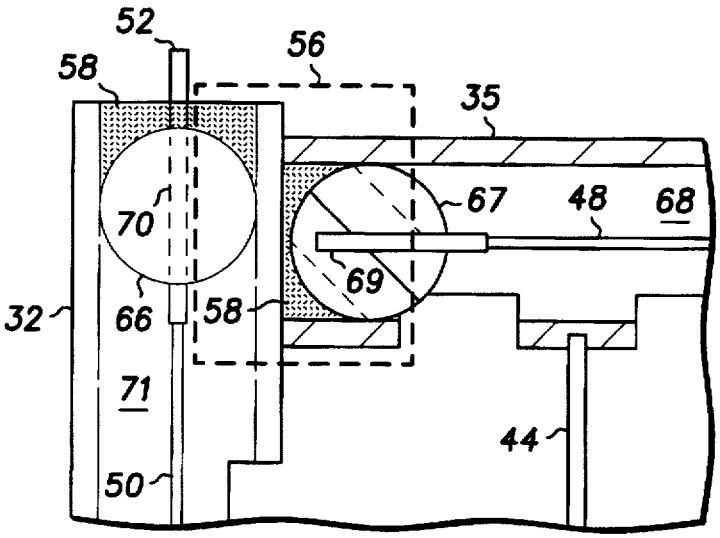
FIG. 12 is an enlarged view of a portion of the structure of FIG. 3, illustrating a joint between adjacent side members of the frame in accordance with the present invention.

Referring now to FIG. 12 there is depicted an enlarged view of a portion of the structure of FIG. 3, illustrating a butt joint 56, delineated generally within a depicted dashed line box, between adjacent side members 35 and 32 of frame 30 in accordance with the present invention. In the present embodiment, all adjacent side members are similarly affixed together adjacent the ends by forming a butt joint surrounded by a hermetic sealant 58 such as, for example, glass frit. In FIG. 12 the end of side member 35 is fish mouthed to fit the contours of side member 32. Butt joint 56 is used when no electrical connection needs to be made to getter material 48 positioned in side member 35.

As further illustrated in FIG. 12, blocking body 67 is positioned adjacent the end of side member 35; similarly, blocking body 66 is positioned adjacent the end of side member 32. Blocking bodies 66 and 67 fill the entire cross-sectional area of side members 32 and 35, respectively. Further, in order to create a hermetic seal, a hermetic sealant 58, such as glass frit, is applied generally surrounding each blocking body 66 and 67 on the side closest the end of side member 32 and 35, respectively.

Getter material 48 is suspended within an internal volume 68 of side member 35 by fixing getter material 48 to blocking body 67 by forming a groove 69 into blocking body 67 and placing the end of getter material 48 into groove 69. Getter material 50 is suspended within an internal volume 71 of side member 32 by fixing getter material 50 to blocking body 66 by forming a hole 70 into blocking body 66 and placing the end of getter material 50 through hole 70. Getter materials 48 and 50 are fixed to blocking bodies 67 and 66, respectively, by heating blocking bodies 67 and 66 so that the material of blocking bodies 67 and 66 (which may be glass) expands to form a tight seal around the inserted portion of getter materials 48 and 50. Hole 70 in blocking body 66 of side member 32 allows a portion of electrode 52 to extend outside frame 30 for electrical connection to a remote voltage source (not shown).

Blocking bodies 60–67 may be formed from materials other than glass, such as, for example, frit. Also, getter materials 48, 49, and 50 may be affixed to their corresponding blocking bodies by alternative methods, such as fritting or anodic bonding.

FIG. 13 is an enlarged view, similar to FIG. 12, of another embodiment of a display spacer structure 14' in accordance with the present invention. Features previously described in conjunction with FIG. 12 are similarly referenced herein, with a prime added to all the numbers to indicate the different embodiment. FIG. 13 illustrates a machined joint 60', delineated generally within a depicted dashed line box, between adjacent side members 35' and 32' of a frame 30' in accordance with the present invention. A hermetic sealant, such as glass frit, is placed on the outside of machined joint 60' to create a hermetic seal. Machined joint 60' is used when both of affixed side members 35' and 32' contain evaporable-type getter material, 51' and 50', respectively, which require an electrical connection to each other and to an outside voltage source. A hole 61' is created in a wall 62' of side member 32', and the adjoining end of side member 35' is machined to fit the contours of side member 32' at hole 61' so that the inner volume of side member 35' is in communication with the inner volume of side member 32'. An electrode 52' is integrally attached to the end of (or is a portion of) evaporable-type getter material 50' positioned within side member 32'. Electrode 52' extends beyond the end of side member 32' and forms an external electrode for the connection of a remote voltage source (not shown). An electrode 53' is integrally attached to the end of (or is a portion of) getter material 51' in side member 35'. Electrode 53' extends into side member 32' and is positioned in electrical contact with electrode 52'. The electrical connection between electrodes 52' and 53' is made by positioning electrode 53' on top of electrode 52' so that they are physically contacting one another, and then spot welding electrodes 52' and 53' together using a laser, which can be directed through the transparent material of side members 32' and/or 35'. A possible alternative to spot welding is performing a high-temperature braze.

A blocking body 66' is positioned adjacent the end of side member 32' so that it fills the entire cross-section of side member 32'. Further, in order to create a hermetic seal, a hermetic sealant 58', such as glass frit, is applied generally surrounding blocking body 66' on the side closest the end of side member 32'. A hole 70' is formed in blocking body 66' so that a portion of electrode 52' extends outside frame 30' and may be electrically connected to a voltage source (not shown). Electrode 52' is fixed to blocking body 66' by heating blocking body 66' so that the material of blocking body 66' (which may be glass) expands to form a tight seal around the inserted portion of electrode 52'.

Figure 14:
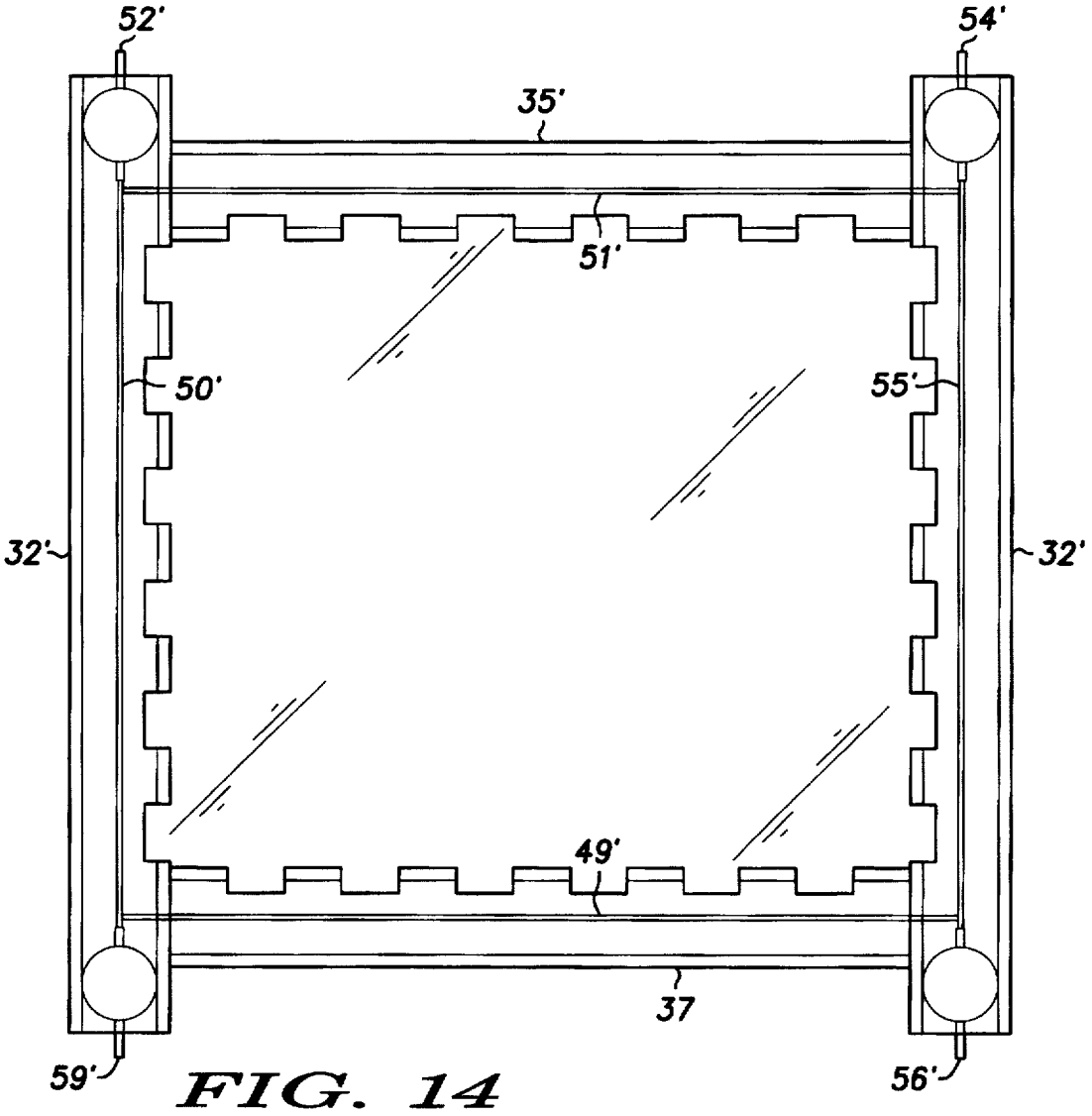
FIG. 14 is a simplified top plan view, similar to FIG. 3, of another embodiment of the present invention wherein each getter material is individually activatable, or all getter materials may be simultaneously activated.

Illustrated in FIG. 14 is a simplified view in top plan of the display spacer structure 14' of FIG. 13. FIG. 14 is similar to FIG. 3 and shows all four side members connected at the corners in the manner described in FIG. 13. Four getter materials 50', 51', 55', and 57' are positioned in side members 32', 35', 32', and 37', respectively, and are connected to external electrodes 52', 54', 56', and 59' at the four corners. An outside voltage source may be applied over each of getter materials 50', 51', 55', and 57' individually or over getter materials 50', 51', 55', and 57' simultaneously. Tabulated in the table below are the electrodes of FIG. 14 across which a voltage source is applied to activate a selected getter material of FIG. 14 or to activate all getter materials 50', 51', 55', and 57' simultaneously. Thus, for example, to activate getter material 51' of FIG. 14, a voltage source is applied over electrodes 52' and 54'.

Getter Refresh or Activation

| Getter(s) to Activate | Apply Voltage across Following Electrodes |
|---|---|
| 50' | 52'–59' |
| 51' | 52'–54' |
| 55' | 54'–56' |
| 57' | 56'–59' |
| 50', 51', 55', 57' simultaneously | 52'–56' or 54'–59' |

A simplified view of another embodiment of a display spacer structure in accordance with the present invention is illustrated in FIG. 15. In this embodiment a frame 14" is formed from a single side member 35" joined together adjacent the ends to define a central opening 33". Side member 35" includes a recessed portion with a getter 51" extending there through and electrically connected to an externally accessible electrode 52".

Figure 16:
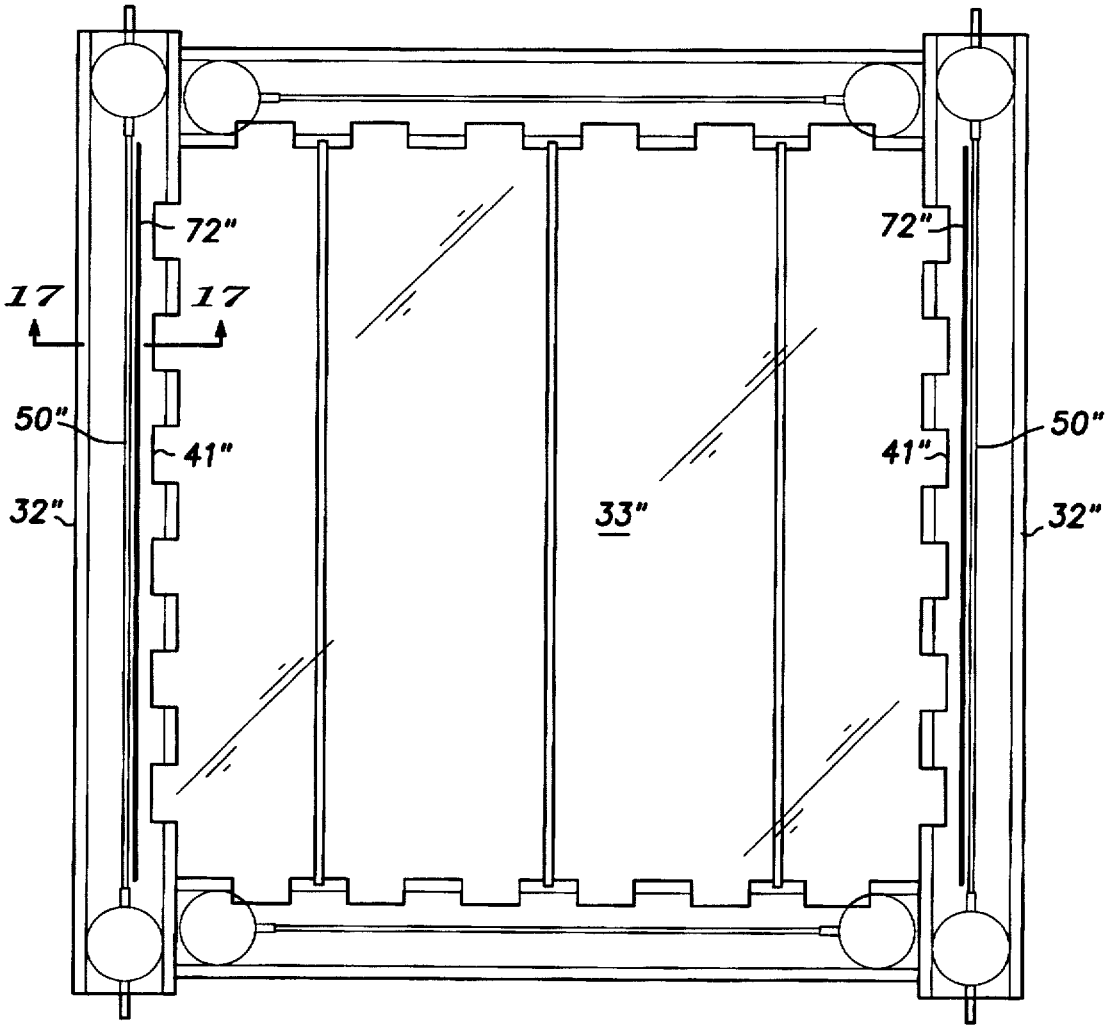
FIG. 16 is a view, similar to FIG. 3, portions thereof broken away, of another embodiment including a shield positioned between the getter material and the holes in accordance with the present invention.

Illustrated in FIG. 16 is a view, similar to FIG. 3, portions thereof broken away, of another embodiment of the present invention. The embodiment of FIG. 16 includes all the features of the embodiment of FIG. 3 and further includes a shield 72" positioned between evaporable-type getter material 50" (in side members 32") and plurality of spaced apart openings 41". Shield 72" is positioned adjacent getter material 50" and acts as a physical barrier so as to prevent the flow of getter into central opening 33" when getter material 50" is activated. When getter material 50" is activated, gaseous getter molecules, or particles, are released into the vacuum of side members 32". Shield 72" ensures that these molecules only deposit on the walls of side members 32" and do not enter central opening 33".

Figure 17:
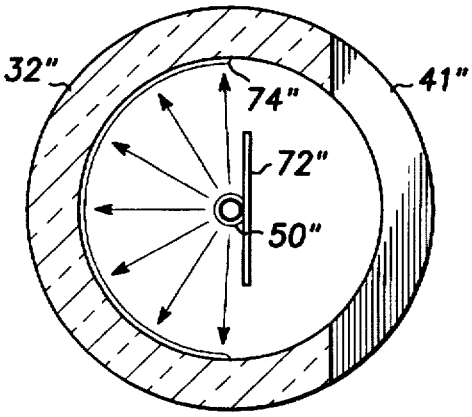
FIG. 17 is a cross-sectional view, as seen from the line 17—17 of FIG. 16, illustrating the getter material, the shield, and particularly pointing out the flow and deposition of getter that occurs when the getter material is activated, in accordance with the present invention.

Referring now to FIG. 17 there is depicted a cross-sectional view as seen from the line 17—17 of FIG. 16 illustrating evaporable-type getter material 50", shield 72", opening 41", and particularly pointing out the flow of getter to deposit a coating 74" of getter on the inner surface of side member 32" when getter material 50" is activated. In the specific embodiment of FIG. 17, shield 72" includes a metal plate, which could be stainless steel, and getter material 50" includes a wire which includes a coating of a getter. The getter is sprayed outward when a current runs through the wire, and the generated heat thermally activates the gettering substance. Shield 72" acts as a physical barrier preventing the exit of getter through opening 41" into central opening 33" (FIG. 16).

Figure 18:
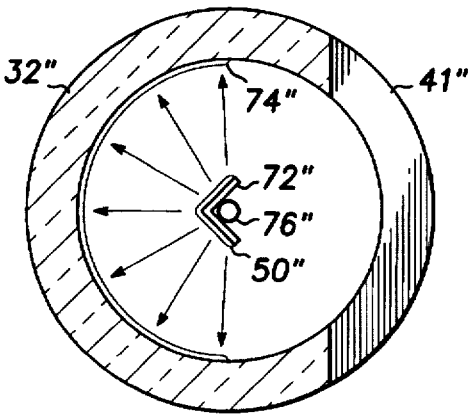
FIG. 18 is a cross-sectional view, similar to FIG. 17, illustrating another embodiment of the present invention and particularly pointing out the flow and deposition of getter that occurs when the getter material is activated.

Illustrated in FIG. 18 is a cross-sectional view, similar to FIG. 17, of another embodiment of the present invention including an alternate shield and getter material configuration. In this specific embodiment, shield 72" includes a bent metal plate which extends the length of side member 32". The side of the plate which faces away from central opening 33" is coated with getter material 50". An electrically conducting wire 76" is positioned in the recess of shield 72" and extends the length of side member 32". Wire 76" is in thermal contact with shield 72". When wire 76" carries a current, the generated heat flows through the plate and activates evaporable-type getter material 50". When getter material 50" is activated, getter is released into the inner volume of side member 32" so that getter coating 74" covers approximately half of the inner surface of side member 32". Shield 72" prevents the flow of getter through opening 41".

Figure 19:
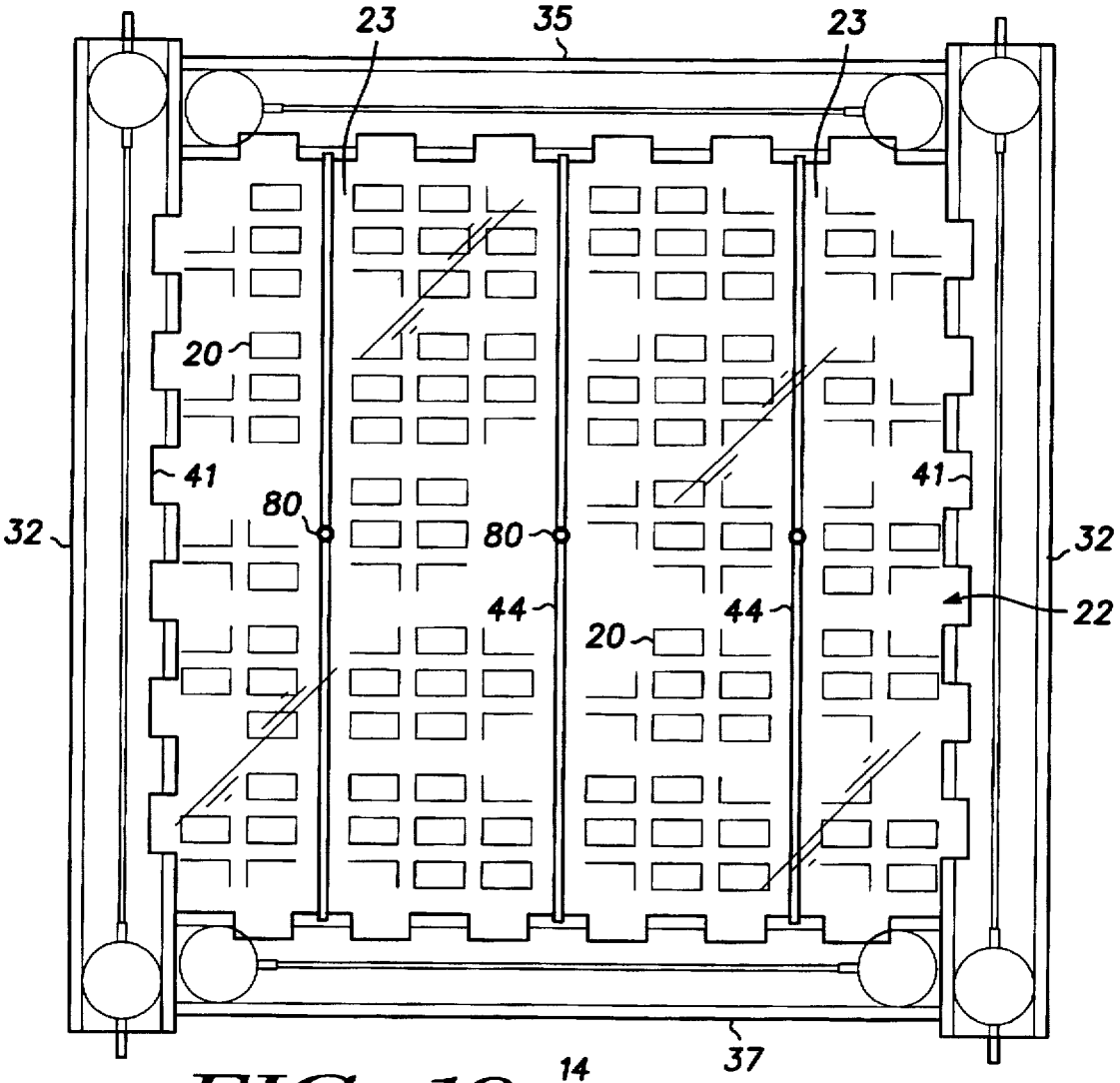
FIG. 19 is a top plan view of the display spacer structure of FIG. 3, positioned on the cathode structure of FIG. 2, in accordance with the present invention.

Referring now to FIG. 19 there is depicted a top plan view of display spacer structure 14, as illustrated in FIG. 3, positioned in abutting engagement with cathode structure 22, as depicted in FIG. 2, in accordance with the present invention. Display spacer structure 14 is positioned on cathode structure 22 so that spacers 44 and side members 32, 35, and 37 are in abutting engagement with regions 23 on the surface of cathode structure 22 and between pixels 20. The side members of display spacer structure 14 are generally aligned with the edges of cathode structure 22. A hermetic seal is formed by applying a hermetic sealant, such as glass frit, generally in the region where side members 32, 35, and 37 physically contact cathode structure 22. Spacers 44 have first and second opposed edges. In the finished display (FIG. 1), the first opposed edge (which is exposed in FIG. 19) of spacers 44 is in abutting engagement with anode structure 10; the second opposed edge of spacers 44 is in abutting engagement with cathode structure 12 so as to prevent the collapse of the display when the display is evacuated. Also illustrated in FIG. 19, spacers 44 are fixed, or tacked, to cathode structure 22 to maintain the proper positioning of spacers 44 between pixels 20. This is accomplished by depositing a small amount of a glass frit material 80 between spacers 44 and the surface 23 of cathode structure 22 such that glass frit material 80 contacts both spacers 44 and surface 23 at one or more positions along the length of spacers 44. By tacking spacers 44 to cathode structure 22 at only one or a few points along their lengths, spacers 44 are free to expand and contract during thermal treatments without creating excessive mechanical stresses in spacers 44. Thus, spacers 44 are protected from breakage during thermal treatments.

Figure 20:
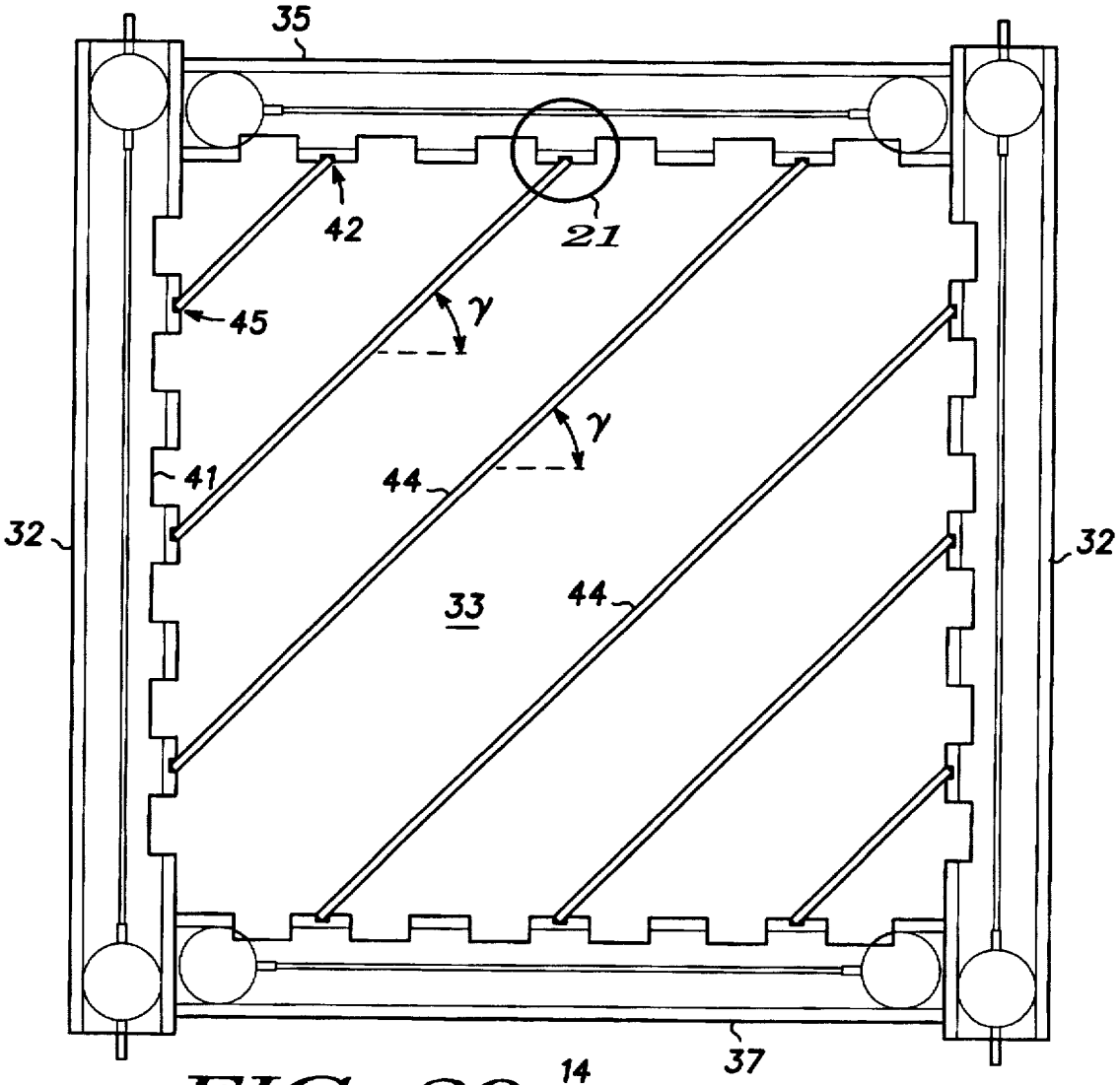
FIG. 20 is a top plan view of another embodiment of a display spacer structure illustrating an alternate spacer orientation in accordance with the present invention.

Referring now to FIG. 20 there is depicted a plan view of another embodiment of display spacer structure 14. The embodiment of FIG. 20 includes all the features of the embodiment of FIG. 3, except spacers 44 vary in length across display spacer structure 14, and spacers 44 traverse central opening 33 at an angle, gamma, to side member 35 in a range greater than zero and less than 90 degrees. In FIG. 20 the first end of each spacer 44 is positioned in one of grooves 42 of side member 35. The opposing end of spacer 44 is positioned in one of a plurality of grooves 45 in adjacent side member 32. All of spacers 44 are similarly positioned in grooves 42 and 45 of adjacent side members 35 and 32 so that spacers 44 are parallel to one another. The length of each spacer 44 depends on the distance between side members 35 and 32 (and 37 and 32, not shown). The total number of spacers and the distance between adjacent spacers are such that sufficient mechanical support is provided to prevent the collapse and distortion of the display.

In FIG. 20 the angle, gamma, is formed (not equal to 90 or 0 degrees) between spacers 44 and side members 32, 35. It is known that an irregularity or gap in the visual image is less discernible by the human eye if it does not lie along the horizontal or vertical lines of the visual image. Thus, any irregularity or gap in the image due to spacers 44 will be made less discernible to the human eye by placing spacers 44 along lines that are not horizontal or vertical to the visual image, as in the configuration described in the present embodiment.

Figure 21:
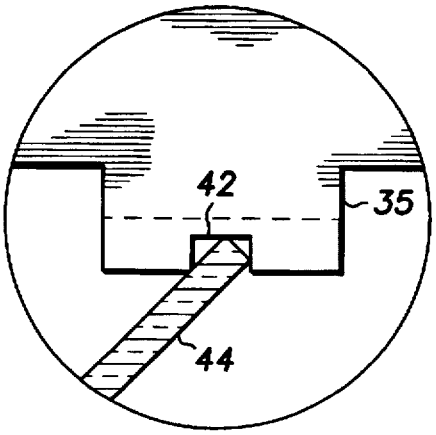
FIG. 21 is a greatly enlarged view of a portion of FIG. 20, illustrating a groove in a side member and the positioning of a spacer within the groove, in accordance with present invention.

Referring now to FIG. 21 there is depicted a greatly enlarged view of a portion of FIG. 20 illustrating groove 42 and the positioning of spacer 44 within groove 42. Groove 42 is cut, in this specific example, using a diamond saw, the blade of which is perpendicular to side member 35. Groove 42 is made to a depth sufficient to accommodate both corners of the end of spacer 44 so that spacer 44 cannot slip out of groove 42. All grooves 42 and 45 are similarly formed. In this embodiment, spacers 44 are not aligned with grooves 42.

Figure 22:
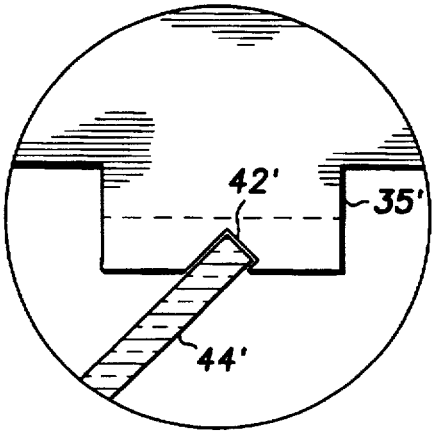
FIG. 22 is a view, similar to FIG. 21, of another embodiment and illustrating an alternate groove in accordance with the present invention.

In an alternative embodiment, which is depicted in FIG. 22, groove 42' is positioned in side member 35' and is formed to generally fit the shape of the end of spacer 44'. Features previously described in conjunction with FIG. 14 are similarly referenced herein, with a prime added to all of the numbers to indicate the different embodiment. The axis of groove 42' is aligned with the axis of spacer 44'. Groove 42' is made, in this specific example, by cutting side member 35' using a diamond saw, the blade of which is positioned at the desired angle. Thus, groove 42' is formed to fit the shape of the end of spacer 44'.

In conclusion, by placing the spacer grooves in the side members of the display frame, as in the present invention, thereby contacting the spacer along the mid portion of its height, a given error in the width of the spacer groove results in less pronounced deviation from perpendicularity, when contrasted to the same error in the width of a spacer groove formed in the cathode or anode structure. Thus, the accuracy required in the fabrication of grooves is relaxed, simplifying the manufacture of the grooves.

Additionally, the display spacer structure of the present invention provides fluid communication between compartments so that the formation of holes in the spacers, which would compromise their mechanical integrity, is not required.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A display spacer structure for a field emission display comprising:

a frame including at least one side member being joined together to define a central opening and to further define first and second spaced apart parallel planes at opposed ends of the central opening, a first of the at least one side member having a recessed portion being positioned outside of, and in communication with, the central opening; and a getter material positioned in said recessed portion.

2. A display spacer structure as claimed in claim 1 wherein the first of the at least one side member has opposed ends, the opposed ends being joined together.

3. A display spacer structure as claimed in claim 1 wherein the first of the at least one side member is an elongated tube; and further including a plurality of spaced apart openings being formed in the tube so as to be in communication with the central opening.

4. A display spacer structure as claimed in claim 3 wherein said elongated tube is made of glass.

5. A display spacer structure as claimed in claim 4 wherein said elongated tube has a circular cross-section.

6. A display spacer structure as claimed in claim 1 wherein the first of the at least one side member is a channel.

7. A display spacer structure as claimed in claim 1 wherein the first of the at least one side member is an elongated bar having a z-shaped cross-section.

8. A display spacer structure as claimed in claim 1 wherein the frame includes a plurality of side members having opposed ends, the side members being joined together adjacent the ends to define said central opening and to further define said first and second spaced apart parallel planes at opposed ends of the central opening.

9. A display spacer structure as claimed in claim 1 wherein the getter material is a nonevaporable-type getter material.

10. A display spacer structure as claimed in claim 1 wherein the getter material is an evaporable-type getter material.

11. A display spacer structure as claimed in claim 10 wherein the getter material has an externally accessible electrode connected thereto and adapted to be electrically connected to a voltage source.

12. A display spacer structure as claimed in claim 11 wherein a second of the at least one side member further includes a similar evaporable-type getter material being electrically connected to the evaporable-type getter material of the first of the at least one side member.

13. A display spacer structure as claimed in claim 10, further including a shield positioned adjacent the getter material so as to prevent a flow of getter into said central opening when the getter material is activated.

14. A display spacer structure as claimed in claim 1 wherein the first of the at least one side member further includes opposed ends; and further including a blocking body being positioned in one of the opposed ends of the first of the at least one side member.

15. A display comprising:

an anode structure defining a plane at an electron receiving area;

a cathode structure defining a plane at an electron emitting area; and a display spacer structure including a frame including at least one side member being joined together to define a central opening and to further define first and second spaced apart parallel planes at opposed ends of the central opening, a first of the at least one side member having a recessed portion being positioned outside of, and in communication with, the central opening, a getter material positioned in said recessed portion, the frame being designed to receive the anode structure and the cathode structure at opposite ends with the plane of the anode structure in the first plane of the frame and the plane of the cathode structure in the second plane of the frame.

16. A display as claimed in claim 15, further including a plurality of spacers having first and second opposed edges, the first opposed edge being in abutting engagement with the anode structure, the second opposed edge being in abutting engagement with the cathode structure so as to prevent the collapse of the display when the display is evacuated.

17. A display spacer structure for a field emission display comprising:

a frame including at least one side member being joined together to define a central opening and to further define first and second spaced apart parallel planes at opposed ends of the central opening, a first of the at least one side member having a recessed portion being positioned outside of, and in communication with, the central opening;

a plurality of spaced apart grooves formed in the first of the at least one side member and a similar plurality of spaced apart grooves formed in a second of the at least one side member;

a plurality of spacers each having first and second ends fixed in the grooves in the first and second side members, respectively, with the spacers extending across the central opening to define a plurality of separate compartments, the spacers extending generally perpendicularly into the first and second spaced apart plane, wherein said recessed portion of the first of the at least one side member is in communication with each of the separate compartments thereby providing a continuous fluid phase throughout the separate compartments.

18. A display spacer structure as claimed in claim 17 wherein said first of the at least one side member is an elongated tube and further including a plurality of spaced apart openings being formed in said elongated tube, the spaced apart openings being in communication with said central opening, one each of the plurality of openings being positioned in each of the separate compartments so as to provide a continuous fluid phase throughout the separate compartments.

19. A display spacer structure as claimed in claim 17, further including a getter material positioned in said recessed portion of the first of the at least one side member.

20. A display spacer structure as claimed in claim 18 wherein said elongated tube is made of glass.

21. A display spacer structure as claimed in claim 20 wherein said elongated tube has a circular cross-section.

22. A display spacer structure as claimed in claim 17 wherein said first of the at least one side member is a channel.

23. A display spacer structure as claimed in claim 17 wherein the first of the at least one side member is an elongated bar having a z-shaped cross-section.

24. A display spacer structure as claimed in claim 17 wherein the frame includes a plurality of side members having opposed ends, the side members being joined together adjacent the ends to define said central opening and to further define said first and second spaced apart parallel planes at opposed ends of the central opening.

25. A display spacer structure as claimed in claim 19 wherein the getter material is a nonevaporable-type getter material.

26. A display spacer structure as claimed in claim 19 wherein the getter material is an evaporable-type getter material.

27. A display spacer structure as claimed in claim 26 wherein the getter material is electrically connected to a voltage source.

28. A display spacer structure as claimed in claim 27 wherein a third of the at least one side member further includes a similar evaporable-type getter material being electrically connected to the evaporable-type getter material of the first one of the side members.

29. A display spacer structure as claimed in claim 26, further including a shield positioned adjacent the getter material so as to prevent a flow of getter into said central opening when the getter material is activated.

30. A display spacer structure as claimed in claim 17 wherein the first of the at least one side member further includes opposed ends; and further including a blocking body being positioned in one of the opposed ends of the first of the at least one side member.

31. A display comprising:

an anode structure defining a plane at an electron receiving area;

a cathode structure defining a plane at an electron emitting area; and a display spacer structure including a frame including at least one side member being joined together to define a central opening and to further define first and second spaced apart parallel planes at opposed ends of the central opening, a first of the at least one side member having a recessed portion being positioned outside of, and in communication with, the central opening;

a plurality of spaced apart grooves formed in the first of the at least one side member and a similar plurality of spaced apart grooves formed in a second of the at least one side member;

a plurality of spacers each having first and second ends fixed in the grooves in the first and second of the at least one side member, respectively, with the spacers extending across the central opening to define a plurality of separate compartments, the spacers extending generally perpendicularly into the first and second spaced apart parallel planes, said recessed portion of the first of the at least one side member being in communication with each of the separate compartments, the display spacer structure being designed to receive the anode structure and the cathode structure at opposite ends with the plane of the anode structure in the first plane of the frame and the plane of the cathode structure in the second plane of the frame.

32. A display as claimed in claim 31 wherein the display spacer structure further includes a getter material positioned in said recessed portion of the first of the at least one side member.

* * * * *